US011137138B2

(12) United States Patent
Ventura

(10) Patent No.: US 11,137,138 B2
(45) Date of Patent: Oct. 5, 2021

(54) HEATING SYSTEM SHUT-OFF SAFETY DEVICE

(71) Applicant: Paul Ventura, Wakefield, MA (US)

(72) Inventor: Paul Ventura, Wakefield, MA (US)

( * ) Notice: Subject to any disclaimer, the term of this patent is extended or adjusted under 35 U.S.C. 154(b) by 1065 days.

(21) Appl. No.: 14/528,764

(22) Filed: Oct. 30, 2014

(65) Prior Publication Data

US 2016/0123587 A1 May 5, 2016

(51) Int. Cl.

| | |
|---|---|
| ***F23N 5/24*** | (2006.01) |
| ***G08B 21/14*** | (2006.01) |
| ***G08B 17/10*** | (2006.01) |
| ***G08B 5/36*** | (2006.01) |
| ***G08B 3/10*** | (2006.01) |

(52) U.S. Cl.

CPC ..... *F23N 5/242* (2013.01); *G08B 3/10* (2013.01); *G08B 5/36* (2013.01); *G08B 17/10* (2013.01); *G08B 21/14* (2013.01); *F23N 2225/14* (2020.01); *F23N 2231/00* (2020.01)

(58) Field of Classification Search

CPC ..... F23N 5/242

See application file for complete search history.

(56) References Cited

U.S. PATENT DOCUMENTS 6,045,352 A * 4/2000 Nicholson ..... F23N 5/245 126/116 A
6,339,379 B1 * 1/2002 Argus ..... F23N 5/242 340/632
2007/0200719 A1 * 8/2007 Adkins ..... G01N 33/004 340/632
2010/0201531 A1 * 8/2010 Pakravan ..... G08B 29/20 340/632
2011/0170377 A1 * 7/2011 Legaspi ..... G08B 25/009 367/199
2011/0260874 A1 * 10/2011 Gassmann ..... H02H 7/228 340/584
2012/0251963 A1 * 10/2012 Barker ..... F23N 5/003 432/1
2014/0098445 A1 * 4/2014 Hooper ..... G08B 17/06 361/42

* cited by examiner

*Primary Examiner* — Jason Lau

(74) *Attorney, Agent, or Firm* — Bay State IP, LLC

(57) ABSTRACT

A heating system shut-off safety assembly includes a housing coupled to an electrical line for a heating unit. A processor is coupled to the housing and the electrical line to allow and restrict an electrical current in the electrical line. A first carbon monoxide sensor is coupled to the housing and the processor to detect carbon monoxide. A heat sensor is coupled to the housing and the processor to detect heat from the heating unit. A smoke sensor is coupled to the housing and the processor to detect smoke from the heating unit. A second carbon monoxide sensor is coupled to a warm air discharge and the processor to detect carbon monoxide in the warm air discharge. The processor restricts the current in the electrical line when the first carbon monoxide sensor, the second carbon monoxide sensor and smoke sensor detects carbon monoxide or smoke to disable the heating unit.

1 Claim, 4 Drawing Sheets

HEATING SYSTEM SHUT-OFF SAFETY DEVICE

BACKGROUND OF THE INVENTION

The disclosure relates to detection devices and more particularly pertains to a new detection device for disabling a heating unit when the heating unit expels carbon monoxide.

SUMMARY OF THE INVENTION

An embodiment of the disclosure meets the needs presented above by generally comprising a housing coupled to an electrical line for a heating unit. A processor is coupled to the housing. The processor is electrically coupled to the electrical line of the heating unit to allow and restrict an electrical current in the electrical line. A first carbon monoxide sensor is coupled to the housing to detect carbon monoxide. The first carbon monoxide sensor is electrically coupled to the processor. Thus, the processor restricts the current in the electrical line when the first carbon monoxide sensor detects carbon monoxide to disable the heating unit. A heat sensor is coupled to the housing to detect heat from the heating unit. The heat sensor is electrically coupled to the processor. A smoke sensor is coupled to the housing to detect smoke from the heating unit. The smoke sensor is electrically coupled to the processor. Thus, the processor restricts the current in the electrical line when the smoke sensor detects smoke to disable the heating unit. A second carbon monoxide sensor is coupled to a warm air discharge to detect carbon monoxide in the warm air discharge. The second carbon monoxide sensor is electrically coupled to the processor. Thus, the processor restricts the current in the electrical line when the second carbon monoxide sensor detects carbon monoxide to disable the heating unit.

These and other features, aspects and advantages of the present invention will become better understood with reference to the following drawings, description and claims.

DETAILED DESCRIPTION OF THE INVENTION

Figure 1:
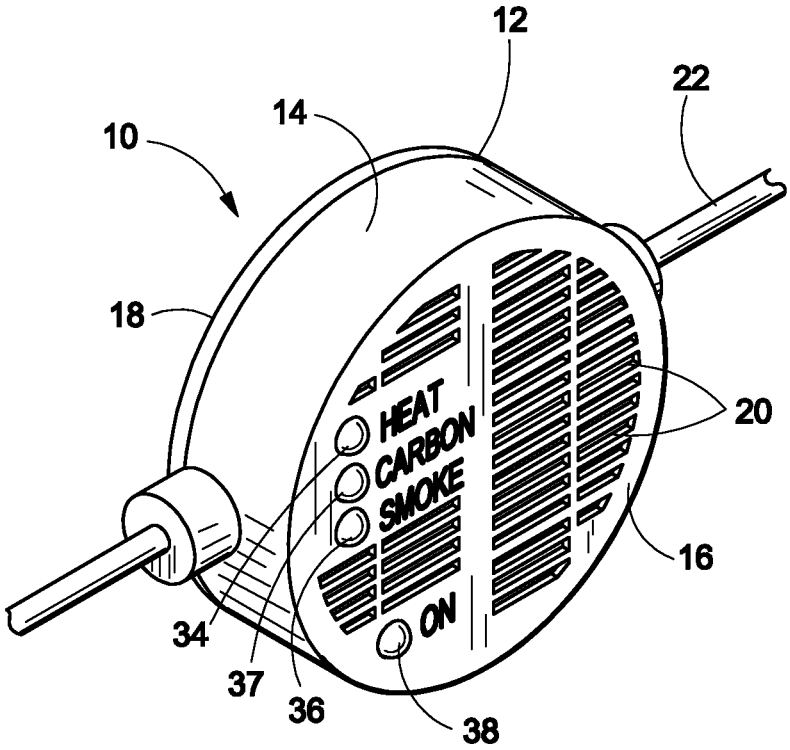
FIG. 1 is a perspective view of a heating system shut-off safety assembly according to an embodiment of the disclosure.
Figure 2:
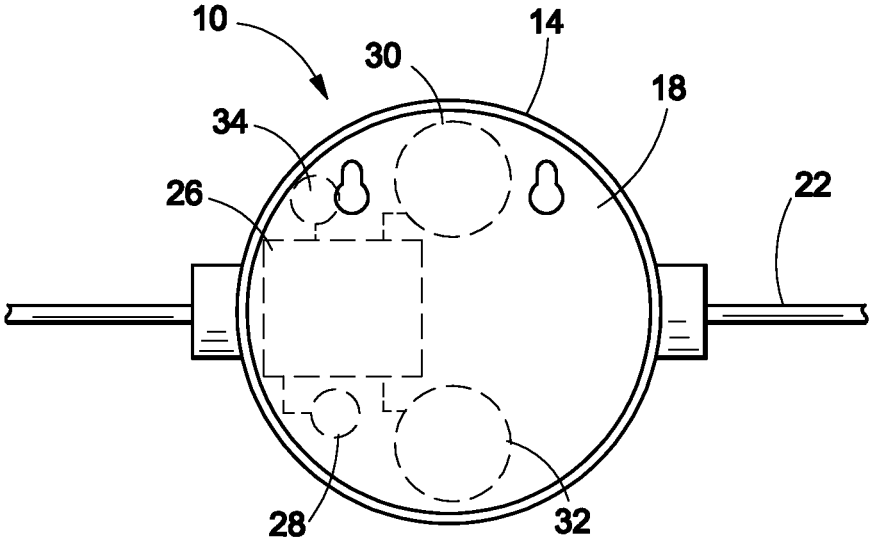
FIG. 2 is a back view of an embodiment of the disclosure.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

With reference now to the drawings, and in particular to FIGS. 1 through 5 thereof, a new detection device embodying the principles and concepts of an embodiment of the disclosure and generally designated by the reference numeral 10 will be described.

As best illustrated in FIGS. 1 through 5, the heating system shut-off safety assembly 10 generally comprises a housing 12. The housing 12 has an outer wall 14 extending between each of a front wall 16 and a back wall 18 of the housing 12. The front wall 16 of the housing 18 has a plurality of vents 20 extending therethrough to allow air to enter into an interior of the housing 12. The housing 12 is coupled to an electrical line 22 of a heating unit 24. The heating unit 24 may be a forced air heating unit utilizing a gaseous fuel source or the like. Alternatively, the heating unit 24 may be an oil fired hot water heater or the like.

A processor 26 is coupled to the housing 12. The processor 26 is electrically coupled to the electrical line 22 of the heating unit 24 to allow and restrict an electrical current in the electrical line 22. The processor 26 may be an electronic processor or the like. A first carbon monoxide sensor 28 is coupled to the housing 12 to detect carbon monoxide. The first carbon monoxide sensor 28 is electrically coupled to the processor 26. Thus, the processor 26 restricts the current in the electrical line 22 when the first 20 carbon monoxide sensor 28 detects carbon monoxide, disabling the heating unit 24.

A heat sensor 30 is coupled to the housing 12 to detect heat from the heating unit 24. The heat sensor 30 is electrically coupled to the processor 26. Thus, the processor 26 restricts the current in the electrical line 22 when the heat sensor 30 detects a threshold temperature, disabling the heating unit 24. A smoke sensor 32 is coupled to the housing 12 to detect smoke from the heating unit 24. The smoke sensor 32 is electrically coupled to the processor 26. Thus, the processor 26 restricts the current in the electrical line 22 when the smoke sensor 32 detects smoke, disabling the heating unit 24.

Each of a heat light emitter 34, a smoke light emitter 36, a carbon light emitter 37 and an on light emitter 38 is coupled to the front wall 16 of the housing 12. Each of the heat light emitter 34, the smoke light emitter 36, the carbon light emitter 37 and the on light emitter 38 is electrically coupled to the processor 26. The heat light emitter 34 emits light when the heat sensor 30 detects a threshold temperature from the heating unit 24. The smoke light emitter 36 emits light when the smoke sensor 32 detects smoke from the heating unit 24. The carbon light emitter 37 emits light when the first carbon monoxide 28 sensor detects carbon monoxide. Each of the heat light emitter 34, the smoke light emitter 36 and the on light emitter 38 may be an LED or the like. The on light emitter 38 emits light to indicate the processor 26 is allowing the flow of current through the electrical line 22. The on light emitter 40 ceases emitting light to indicate a restriction of the current through the electrical line 22.

Figure 3:
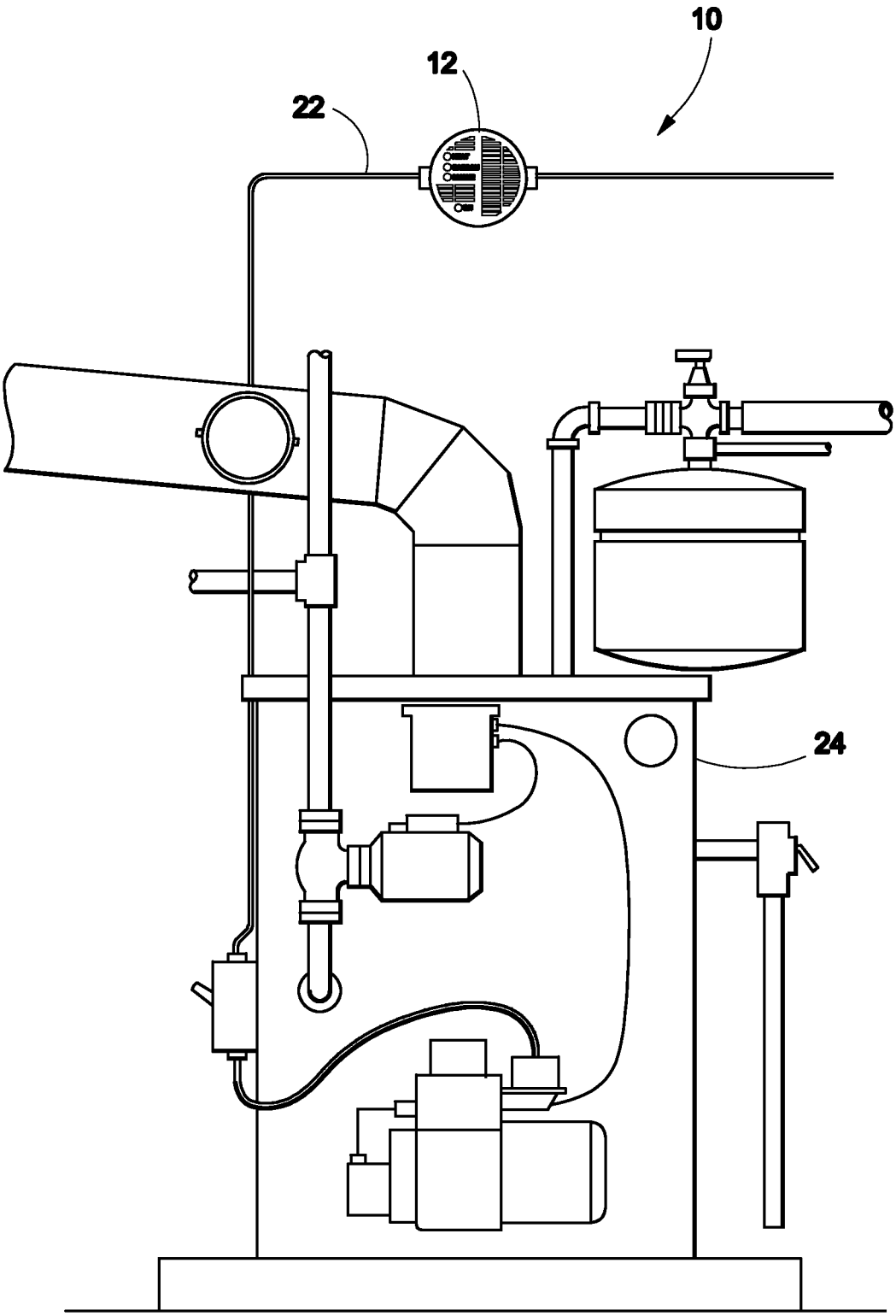
FIG. 3 is an in-use view of a water heating embodiment of the disclosure.
Figure 4:
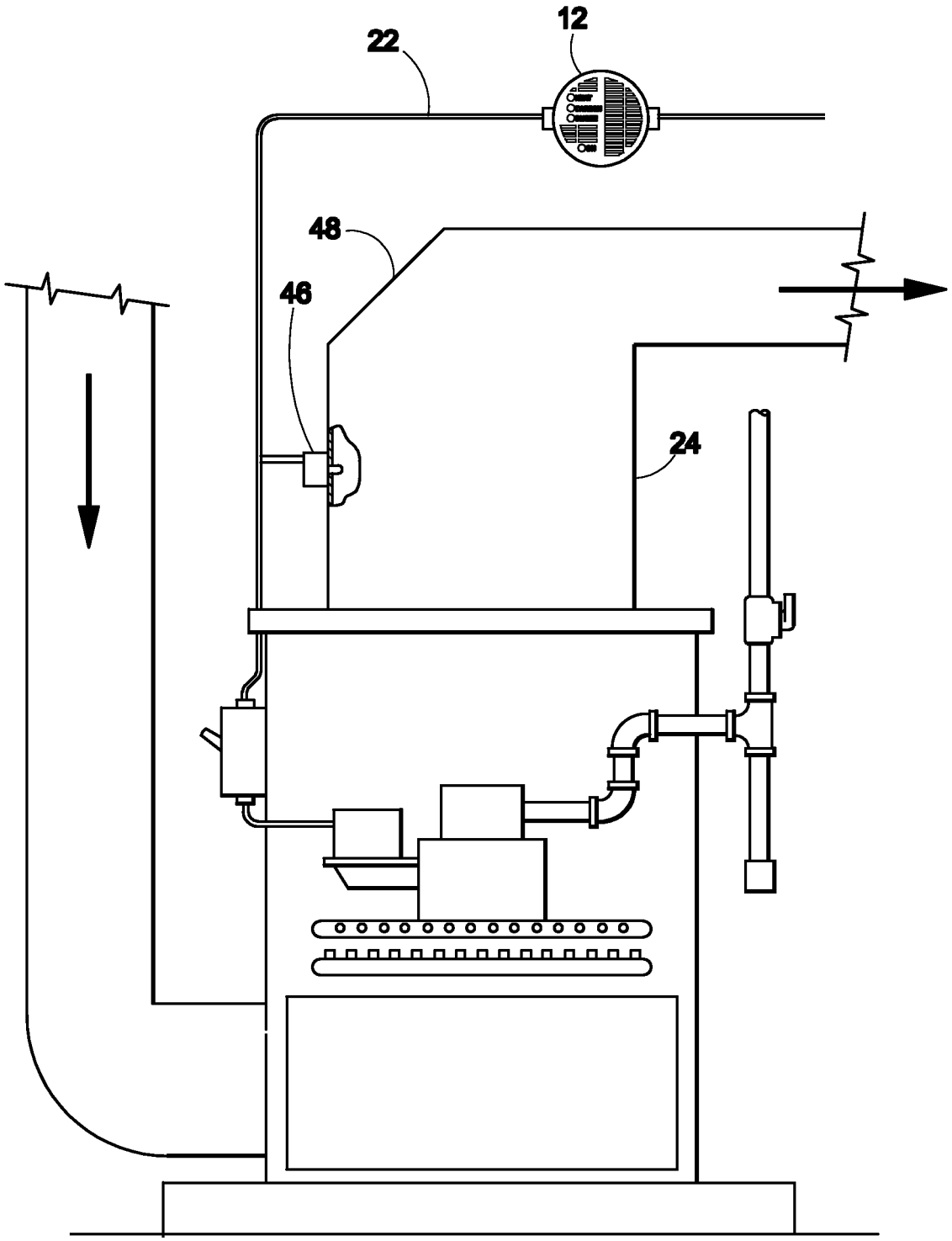
FIG. 4 is an in-use view of a forced air embodiment of the disclosure.
Figure 5:
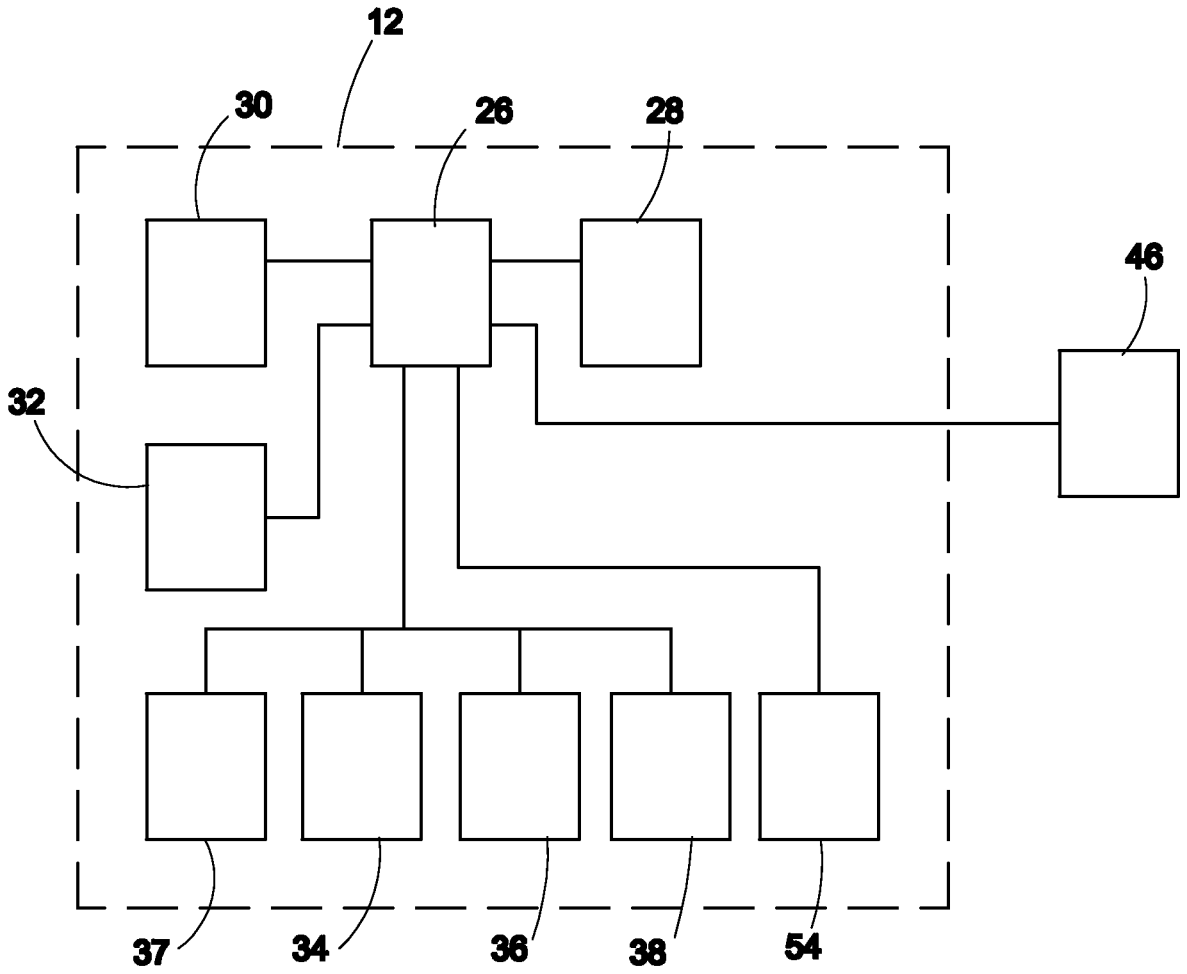
FIG. 5 is a schematic view of an embodiment of the disclosure.

A second carbon monoxide sensor 46 is coupled to a warm air discharge 48 to detect carbon monoxide in the warm air discharge 48. The second carbon monoxide sensor 46 is electrically coupled to the processor 26 such that the processor 26 restricts the current in the electrical line 22 when the second carbon monoxide sensor 46 detects carbon monoxide, disabling the heating unit 24. As shown in FIG. 3, the housing 12 may be positioned proximate an oil fired water heater. As shown in FIG. 4, the second carbon monoxide sensor 46 may be coupled to the warm air discharge 48 of the forced air heating unit.

An alarm 54 is provided. The alarm 54 is coupled to the housing 12. The alarm 54 is electrically coupled to the processor 26. Thus, the alarm 54 emits an audible alarm when the first carbon monoxide sensor 28 detects carbon monoxide. The second carbon monoxide sensor 46 detects carbon monoxide and when the smoke sensor 32 detects smoke.

In use, the first carbon monoxide sensor 28 detects carbon monoxide being released from the heating unit 24 into the atmosphere. The second carbon monoxide sensor 46 detects carbon monoxide in the warm air discharge 48. The heating unit 24 is disabled when either of the first 28 or second 46 carbon monoxide sensors detects carbon monoxide. The heating unit 24 remains disabled until the heating unit 24 is serviced by an authorized service representative.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

What is claimed is:

1. A heating system shut-off safety assembly consisting of:

a housing, said housing having an outer wall extending between each of a front wall and a back wall of said housing, said front wall of said housing having a plurality of vents extending therethrough such that said vents are configured to allow air to enter an interior of said housing, said housing being configured to be coupled to an electrical line for a heating unit;

a processor coupled to said housing, said processor being electrically coupled to the electrical line of the heating unit such that said processor is configured to allow and restrict an electrical current in the electrical line;

a first carbon monoxide sensor is configured to detect carbon monoxide, said first carbon monoxide sensor being electrically coupled to said processor such that said processor restricts the current in the electrical line when said first carbon monoxide sensor detects carbon monoxide wherein the heating unit is disabled;

a heat sensor coupled to said housing such that said heat sensor is configured to detect heat from the heating unit, said heat sensor being electrically coupled to said processor;

a smoke sensor coupled to said housing such that said smoke sensor is configured to detect smoke from the heating unit, said smoke sensor being electrically coupled to said processor such that said processor restricts the current in the electrical line when said smoke sensor detects smoke wherein the heating unit is disabled; and each of a heat light emitter, a smoke light emitter, a carbon light emitter and an on light emitter being coupled to said front wall of said housing, each of said heat light emitter, said smoke light emitter, said carbon light emitter and said on light emitter being electrically coupled to said processor, said heat light emitter emitting light when said heat sensor detects heat from the heating unit, said smoke light emitter emitting light when said smoke sensor detects smoke from the heating unit, said carbon light emitter emitting light when said first carbon monoxide sensor senses carbon monoxide, said on light emitter emitting light to indicate a charge in said power supply, said on light emitter emitting light to indicate said processor is allowing the flow of current through the electrical line, said on light emitter ceasing emitting light to indicate a restriction of the current through the electrical line;

a second carbon monoxide sensor coupled to a warm air discharge of said heating unit such that said second carbon monoxide sensor is configured to detect carbon monoxide within the warm air discharge, said second carbon monoxide sensor being electrically coupled to said processor such that said processor restricts the current in the electrical line when said second carbon monoxide sensor detects carbon monoxide wherein the heating unit is disabled; and an alarm coupled to said housing, said alarm being electrically coupled to said processor wherein said alarm emits an audible alarm when said first carbon monoxide sensor detects carbon monoxide, said second carbon monoxides sensor detects carbon monoxide and when said smoke detector detects smoke;

wherein the processor, the first carbon monoxide sensor, the heat sensor, the smoke sensor, the heat light emitter, the smoke light emitter, the carbon light emitter the on light emitter, the second carbon monoxide sensor and the alarm are contained by the housing.

* * * * *